US010366852B2

(12) United States Patent
Birner et al.

(10) Patent No.: US 10,366,852 B2
(45) Date of Patent: Jul. 30, 2019

(54) POWER RELAY FOR A VEHICLE

(71) Applicant: ELLENBERGER & POENSGEN GMBH, Altdorf (DE)

(72) Inventors: Markus Birner, Zirndorf (DE); Manuel Engewald, Nuremberg (DE); Ricardo Pimenta, Eckental (DE); Helmut Kraus, Berg (DE); Wolfgang Weiss, Altdorf (DE); Matthias Schwarz, Burgthann (DE); Sebastian Rothmayr, Nuremberg (DE); Thomas Singer, Berg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 194 days.

(21) Appl. No.: 15/357,156

(22) Filed: Nov. 21, 2016

(65) Prior Publication Data

US 2017/0069450 A1 Mar. 9, 2017

Related U.S. Application Data

(63) Continuation of application No. PCT/EP2015/001032, filed on May 21, 2015.

(30) Foreign Application Priority Data

May 21, 2014 (DE) ..... 10 2014 007 459

(51) Int. Cl.

| | |
|---|---|
| ***H01H 50/04*** | (2006.01) |
| ***H01H 50/02*** | (2006.01) |
| ***H01H 50/12*** | (2006.01) |
| ***H01H 50/36*** | (2006.01) |
| ***H01H 47/22*** | (2006.01) |
| ***H01H 50/20*** | (2006.01) |

(Continued)

(52) U.S. Cl.

CPC ..... *H01H 50/047* (2013.01); *H01H 47/22* (2013.01); *H01H 50/023* (2013.01);

(Continued)

(58) Field of Classification Search

USPC ..... 361/139, 160; 335/126, 131, 151

See application file for complete search history.

(56) References Cited

U.S. PATENT DOCUMENTS

| | | | |
|---|---|---|---|
| 6,693,503 | B1 | 2/2004 | Nguyen et al. |
| 7,569,787 | B2 | 8/2009 | Kurasawa et al. |

(Continued)

FOREIGN PATENT DOCUMENTS

| | | | |
|---|---|---|---|
| CN | 2226800 | Y | 5/1996 |
| CN | 101090049 | A | 12/2007 |

(Continued)

*Primary Examiner* — Danny Nguyen

(74) *Attorney, Agent, or Firm* — Laurence A. Greenberg; Werner H. Stemer; Ralph E. Locher

(57) ABSTRACT

A power relay for a vehicle is disclosed. The power relay has a housing formed by a connector base and a housing can set thereon, two connection bolts being inserted into the connector base for contacting a load circuit. The power relay further has a coil subassembly arranged in the housing and containing a solenoid coil and an armature. The armature is coupled by a force-transmission member to a contact bridge and can shift in the housing, under the effect of a magnetic field generated by the solenoid coil, in such a way that the contact bridge can be reversibly moved between a closing position, in which the contact bridge bridges the connection bolts in an electro conducting manner, and an opening position, in which the contact bridge is not in contact with the connection bolts. The housing can is configured as an injection-molded component made of plastic.

18 Claims, 14 Drawing Sheets

(51) Int. Cl.

| | |
|---|---|
| *H01H 47/00* | (2006.01) |
| *H01H 50/14* | (2006.01) |
| *H01H 50/30* | (2006.01) |
| *H01H 50/54* | (2006.01) |
| *H01H 50/44* | (2006.01) |

(52) U.S. Cl.

CPC ..... *H01H 50/041* (2013.01); *H01H 50/12* (2013.01); *H01H 50/20* (2013.01); *H01H 50/36* (2013.01); *H01H 47/001* (2013.01); *H01H 47/002* (2013.01); *H01H 47/226* (2013.01); *H01H 50/021* (2013.01); *H01H 50/14* (2013.01); *H01H 50/30* (2013.01); *H01H 50/546* (2013.01); *H01H 2050/446* (2013.01); *H01H 2231/026* (2013.01); *H01H 2235/01* (2013.01)

(56) References Cited

U.S. PATENT DOCUMENTS

| | | | | |
|---|---|---|---|---|
| 8,188,818 | B2 * | 5/2012 | Cho | H01H 50/023 335/126 |
| 2002/0097119 | A1 | 7/2002 | Molyneux et al. | |
| 2004/0027776 | A1 * | 2/2004 | Uotome | H01H 47/06 361/160 |
| 2006/0050466 | A1 * | 3/2006 | Enomoto | H01H 50/02 361/160 |
| 2011/0120844 | A1 | 5/2011 | Hoffmann et al. | |
| 2011/0267157 | A1 | 11/2011 | Kalmbach et al. | |
| 2011/0267158 | A1 | 11/2011 | Kalmbach et al. | |
| 2013/0214882 | A1 * | 8/2013 | Ito | H01H 1/20 335/151 |

FOREIGN PATENT DOCUMENTS

| | | | |
|---|---|---|---|
| CN | 102074387 | A | 5/2011 |
| DE | 19542142 | A1 | 5/1997 |
| DE | 102010018738 | A1 | 11/2011 |
| DE | 102010018755 | A1 | 11/2011 |
| JP | 2005038705 | A | 2/2005 |
| JP | 2006019148 | A | 1/2006 |
| JP | 2006170076 | A | 6/2006 |
| KR | 1020010089666 | A | 10/2001 |
| KR | 1020110138345 | A | 12/2011 |
| WO | 0247101 | A1 | 6/2002 |
| WO | 2010090618 | A2 | 8/2010 |

* cited by examiner

POWER RELAY FOR A VEHICLE

CROSS-REFERENCE TO RELATED APPLICATION

This is a continuation application, under 35 U.S.C. § 120, of copending international application No. PCT/EP2015/001032, filed May 21, 2015, which designated the United States; this application also claims the priority, under 35 U.S.C. § 119, of German patent application No. DE 10 2014 007 459.5, filed May 21, 2014; the prior applications are herewith incorporated by reference in their entirety.

BACKGROUND OF THE INVENTION

Field of the Invention

The invention relates to a power relay for a vehicle, in particular a commercial vehicle.

Power relays of the type in question are used in vehicle engineering, especially on commercial vehicles. Here, power relays are used, on the one hand, to separate the vehicle battery electrically from the onboard electrical system. On the other hand, such relays are used to switch electric motors of actuating devices (e.g. hydraulic pumps or lifting platforms). A power relay of this kind must be capable of switching currents up to a current intensity of about 300 amperes at a low voltage, typically of 12 to 24 volts, and must be of correspondingly massive construction. Conventional relays used for this purpose generally consist of a pot-shaped body made of metal (e.g. iron or steel), in which a solenoid coil, a magnet yoke and an armature connected to a contact bridge (dual contact) are accommodated.

To connect the power relays to a load circuit to be switched in the vehicle, the power relay generally has solid terminal studs (threaded bolts) made of metal, which typically have a diameter of 0.5 to 1 cm. As required, cable lugs of the connecting leads of the load circuit to be switched are fixed on these terminal studs by screw nuts (contact nuts) so as to make contact.

Power relays of this kind are known especially from published, non-prosecuted German patent applications DE 10 2010 018 755 A1 (corresponding to U.S. patent publication No. 2011/0267158) and DE 10 2010 018 738 A1 (corresponding to U.S. patent publication No. 2011/0267157).

It is disadvantageous that the conventional power relays are relatively heavy and complex to manufacture. Another problem of the conventionally used power relays is that currently many different design variants are used, differing from one another in having different spacing between the terminal studs and different mounting options for the relay housing (on the side of the housing can, via the connection side or via the relay housing bottom situated opposite the latter).

In order to be able to provide a comprehensive service to the market, especially to enable commercial vehicles with different onboard electrical system configurations to be serviced and, when required, retrofitted with new power relays, it is therefore necessary to stock a large number of different designs of the power relay, leading to considerable expenditure on production and storage.

SUMMARY OF THE INVENTION

It is the underlying object of the invention to specify a power relay for a vehicle, in particular a commercial vehicle that can be produced in a particularly efficient way and is of particularly lightweight construction.

The power relay according to the invention contains a housing, which is formed by a connector base and a housing can mounted thereon. Inserted into the connector base are two terminal studs, via which the power relay can be brought into contact with connecting leads of an external load circuit to be connected. The power relay furthermore contains a coil subassembly, which is arranged in the housing and has a solenoid coil and a corresponding armature. In this arrangement, the armature is coupled by a force-transmission member to a contact bridge and can be moved in the housing, under the action of a magnetic field generated by the solenoid coil, in such a way that the contact bridge can be moved reversibly between a closed position and an open position. In this arrangement, the closed position is characterized in that the contact bridge bridges the terminal studs in an electrically conducting manner, as a result of which the power relay is switched on. In contrast, the open position is characterized in that the contact bridge is not in contact with the terminal studs, with the result that there is no conducting connection between the terminal studs and the power relay is thus switched off.

According to the invention, the housing can is configured as an injection molded component made of plastics. In comparison with conventional power relays provided with a housing can made of metal, this allows a significant reduction in the outlay on production and materials and furthermore a decisive weight saving. The connector base is also preferably an injection molded component made of plastics.

Here, the power relay according to the invention can optionally be a bistable relay, which permanently maintains both the closed position and the open position in the deenergized state of the solenoid coil, or a monostable relay. In the latter case, the power relay can be configured as a normally open or a normally closed relay, wherein the relay automatically adopts the open position in the former design and the closed position in the latter design when the solenoid coil is deenergized. Both the bistable and the monostable designs of the power relay are preferably implemented in accordance with the principle of construction according to the invention.

In a preferred embodiment, the coil subassembly furthermore contains a magnet yoke. In order to achieve a high stability of the housing, despite a low weight and despite a compact construction, the magnet yoke expediently contains a torsionally stable structure, which is accommodated nonrotatably in the housing can over the entire axial height of the can. Here, axial height refers to the extent of the housing can along the axis of the housing can perpendicular to the bottom of the housing can. In an expedient embodiment, the torsionally stable structure of the magnet yoke is formed by an integral hoop angled in a U shape, the legs of which fit around the solenoid coil, parallel to the coil axis thereof. To enable the torsionally stable structure of the magnet yoke, in particular the hoop, to be accommodated nonrotatably, the housing can preferably has an at least approximately rectangular cross section, at least in the interior thereof, wherein the magnet yoke, in particular the hoop, extends in the manner of a cross member parallel to two of the four side walls and is supported on both sides on the two remaining side walls.

By virtue of the nonrotatable accommodation of the magnet yoke, the housing can transmits a torque acting thereon, caused by the tightening of the contact nuts for example, into the magnet yoke of torsionally stable design. When the housing can is subject to torsion, the magnet yoke, in particular the hoop, must therefore always be twisted with it, as a result of which the housing can is, in turn, relieved of load. Material fatigue or even fracture of the housing can is thereby counteracted.

In order to further improve the torsional stability of the housing, the connector base is preferably also coupled to the magnet yoke in a manner secure against rotation, e.g. by virtue of the magnet yoke engaging positively by molded projections in corresponding depressions in the connector base. In this way, any torques which may be exerted on the connector base are not merely transmitted indirectly to the magnet yoke via the housing can. On the contrary, at least a proportion of these torques is introduced directly into the magnet yoke by the connector base, as a result of which, in turn, the housing can and, in particular, the joint between the housing can and the connector base are relieved of load.

In the context of the invention, it is possible, in principle, for the power relay to be a purely electromechanical component, in which the solenoid coil is activated (energized) and deactivated (deenergized) exclusively on the basis of external control signals. However, the power relay preferably additionally contains control electronics accommodated in the housing for activating the solenoid coil. Here, the control electronics convert external control signals (which, in this case, can also be output as pulse signals, in particular in digital form, for example) into a corresponding control current for the solenoid coil. Optionally, the control electronics furthermore include further functions, e.g. current or voltage measurement across the terminal studs and/or protective functions which bring about forced switching off of the power relay in the case of over- and/or under voltage, overload or—in the case of multipole embodiments of the power relay a fault current or an asymmetrical current distribution.

Both in the case of purely electromechanical designs and in the case of electronic designs, the power relay contains a number of signal terminals, each of which can be connected to an external signal line. The signal terminals are expediently fixed in the connector base, as are the terminal studs for the load current.

Here, the signal terminals are used to supply at least one electric control signal to the power relay and/or to output at least one electric state signal through the power relay. Moreover, at least one of the signal terminals is optionally provided for supplying an electric supply voltage or an electric reference potential, in particular ground. In a purely electromechanical design of the power relay, the signal terminals are brought into contact directly with the solenoid coil. In electronic designs of the power relay, in contrast, at least some of the signal terminals are generally connected to the control electronics. In this case, these control electronics make available additional functions (e.g. measurement functions, protective functions, bus communication etc.). In the latter case, the signals supplied via the signal terminals are generally used only indirectly to activate the solenoid coil.

Power relays of the type in question are often used in harsh usage environments, in which these relays are exposed to water, oil, dust and other contaminants. The housing of such power relays must therefore generally be dust- and fluid tight (in particular according to degree of protection IP6K7 or IP6K9K). In order to guarantee the required tightness as regards the connection of the housing can to the connector base, the connector base is preferably connected fluid tightly to the housing can by a setting potting compound, e.g. an epoxy resin. In order to allow simple and durable potting of this joint, the housing can in an advantageous embodiment has, on the opening side, an encircling shoulder, on which the connector base rests by an encircling radial web. In this arrangement, the housing can surrounds the radial web of the connector base on the outside by means of a collar, wherein the collar projects axially beyond the radial web. The collar of the housing can thus forms a rim in the manner of a balustrade around the radial web formed on the connector base. The collar and the connector base thus form a trough-type receptacle (referred to below as "trough" for short) for the potting compound. In the assembled state of the power relay, this trough is completely or at least partially filled with the potting compound.

Each of the signal terminals described above is connected via an associated connecting conductor (preferably formed by a bent sheet metal stamping) to the solenoid coil or the control electronics optionally connected ahead of the latter. Here, each of the connecting conductors is preferably passed through the connector base in the region of the trough. During the potting of the housing, each of the connecting conductors is thus also embedded in the potting compound, thereby also sealing the passage of the connecting conductors through the connector base without the need for special measures for this purpose.

In order to further stabilize the connection between the housing can and the connector base, the collar of the housing can is provided with at least one radial contour in the region of the trough. In this arrangement, the radial contour or each radial contour of the collar can be formed by a radial recess (which reduces the material thickness of the collar) or by a radial projection (which increases the material thickness of the collar). At least one mating contour is formed on the connector base in the region of the trough to correspond to the radial contour or each radial contour. In this arrangement, the radial contour and the corresponding mating contour form a positive joint with the potting compound, by means of which joint the connector base and the housing can are locked to one another in the circumferential direction, i.e. tangentially to the axis of the solenoid coil and of the housing can. Owing to this locking, rotation of the connector base relative to the housing can is also effectively blocked by the potting compound. The radial contour and the corresponding mating contour furthermore preferably have undercuts, by virtue of which the housing can and the connector base are also locked to one another in the radial direction through positive engagement of the potting compound with the radial contour and the mating contour. In this way, radial bulging of the housing can, which would cause the collar of the housing can to come away from the radial web of the connector base, at least locally, is prevented by the potting compound. In a preferred variant embodiment, the radial contour is configured as a latching nose which fits over the radial web and thus latches on the housing can.

As is known, a high gas pressure generally arises in the interior of the housing when a relay of the type in question switches, especially in the event of a short circuit, and this gas pressure could lead under unfavorable circumstances to an explosion or at least to uncontrolled bursting of the relay housing. Here, the reason for the high gas pressure can consist in the expansion of the air in the interior of the housing due to heating and/or in the evaporation of residual moisture in the air held in the interior of the housing. The heating of the air can, in turn, be caused by a switching arc or by the heating of the current-carrying parts due to the current flow (especially a short circuit current). The explosion or the uncontrolled bursting of the housing can lead to dangerous situations, in particular a short circuit between current-carrying parts and ground and an associated risk of fire or personal injury, and must therefore be eliminated. In order to meet this safety requirement in a power relay which is as compact and lightweight as possible, an excess pressure safeguard is provided in the housing—and preferably in the housing can—in an advantageous embodiment of the power relay, the safeguard opening a gas expulsion opening in the case of a critical excess pressure in the housing and thus ensuring controlled pressure equalization with the environment. The excess pressure safeguard can be formed by a separately produced valve, which is inserted into the housing can (or optionally into the connector base), in particular by a spring-loaded ball valve or a diaphragm which tears under excess pressure (and can optionally be supplied as a semi permeable, i.e. gas-permeable but not liquid-permeable, diaphragm).

However, the excess pressure safeguard is preferably integrated integrally into the housing (and here, in particular, into the housing can), in particular molded onto the housing. In this embodiment, the excess pressure safeguard is formed, in particular, by a predetermined breaking point, which bursts in the event of excess pressure and thus opens the gas expulsion opening to relieve the load on the other regions of the housing. The predetermined breaking point preferably has a bent shape, e.g. a U-shaped, V-shaped or trapezoidal shape, and thus surrounds on three sides a tab-type housing section (referred to below as a "tab"), which forms the closure of the excess pressure safeguard. The fourth side of this tab is expediently formed as a film hinge along a connecting line extending between the ends of the predetermined breaking point. The tab framed by the predetermined breaking point here forms a gas expulsion opening with a defined shape and size. In this case, the film hinge joining the predetermined breaking point enables the tab to be bent out of the housing wall in a defined manner as the predetermined breaking point bursts, but prevents the tab from tearing off in an uncontrolled manner, thereby counteracting a potential hazard to people or damage to adjacent parts. In a particularly advantageous variant embodiment, the predetermined breaking point has a keyhole shape, in particular, that is to say is of U-shaped design with a base that is formed in a circular shape.

Since the housing of the power relay is no longer leak tight after the predetermined breaking point bursts, it is generally necessary to replace the power relay in this case. To exclude the possibility of the power relay nevertheless continuing to be used, the power relay is provided in an expedient development with a safety function, which produces a warning signal after the failure of the predetermined breaking point and/or forcibly switches the power relay into a safe state. In one embodiment of the power relay, the safety function comprises forced switching off, by which the power relay switches off permanently and is thus taken irreversibly out of operation—by breaking the contact between the contact bridge and the terminal studs. However, for certain embodiments—as an adaptation to the respective use—the safety function of the power relay can also comprise switching on the power relay. Thus, for example, a power relay used as a battery switch in a commercial vehicle must remain switched on, even in the event of a fault, since otherwise the electrical supply to the onboard electrical system would break down, possibly while traveling.

In the context of the invention, it is possible, in principle, here to provide for the forced switching off to be used to detect the case of excess pressure independently of the state of the predetermined breaking point, e.g. by a separate excess pressure sensor, which is triggered in a critical case of excess pressure. However, the forced switching off is preferably triggered directly by the bursting of the predetermined breaking point. For this purpose, in an expedient embodiment, an electric safety line is coupled mechanically to the predetermined breaking point in such a way that the safety line is severed if the predetermined breaking point fails. In this arrangement, the safety line is in—direct or indirect—operative connection with the solenoid coil, with the result that the severing thereof brings about the forced switching off of the power relay. In this arrangement, the safety line can be part of the power supply for the solenoid coil or part of a signal circuit connected to the control electronics that may be present. In the context of the invention, it is furthermore conceivable, in principle, that the safety line is switched through electrically if the predetermined breaking point fails, wherein, in this case, the switching through (i.e. the coming into being of a conductive connection via the safety line) triggers the forced switching off, or that the state of the predetermined breaking point is monitored by some other sensor.

In order to simplify the installation of the power relay, the coil subassembly is preferably configured as an inherently stable (intrinsically stable) and coherent modular unit. Thus, the coil subassembly is configured in such a way that it holds together without the surrounding parts of the housing. This makes it possible to assemble the coil subassembly outside the housing, this being suitable, in particular, for automated manufacture, and to insert it as a whole into the housing.

In an expedient embodiment of the power relay, the core element of the inherently stable coil subassembly is a support body, which is configured as an integral injection molding made of plastics and onto which the solenoid coil is directly wound. The support body furthermore preferably also supports the armature, which is provided with sliding support for this purpose directly in the support body.

In an expedient embodiment, the support body contains at least one pocket, which is provided to accommodate a pole shoe of the magnet yoke and—where present—at least one permanent magnet. In this case, permanent magnets are provided for bistable designs of the power relay.

On the inside, the pocket or each pocket preferably has a wall with a defined wall thickness of between 0.2 mm and 0.5 mm, in particular about 0.3 mm, by which the corresponding pole shoe of the magnet yoke is spaced apart from the armature guided in the interior of the support body. By the wall being formed integrally with the support body, an effective magnetic flux is achieved within the magnetic circuit formed by the magnet yoke and the armature, wherein, at the same time, the magnetic conditions within this magnetic circuit can be adjusted with high precision and high consistency with respect to time.

A holder or at least installation space for at least one freewheeling diode and/or a holder for a thermal cutoff and/or a holder for a switching position contact for detecting the switching position of the power relay is/are preferably molded into the support body. In this context, a thermal cutoff is taken to mean an electric or electronic component which opens by melting or mechanical movement under the influence of external heat production (unlike a fuse, therefore, not under the action of the current flowing through the component) and thus interrupts the circuit passing via the thermal cutoff. By virtue of the holders described above, which are preferably provided in combination on the support body, this support body is designed as a multifunction part which can be used unmodified in a large number of different designs of the power relay, particularly in designs with and without freewheeling diodes, designs with and without a thermal cutoff and designs with and without a switching position contact. The holders are thus formed on the support body, in particular also in designs of the power relay in which the respective functional component, i.e. the free-wheeling diode, the thermal cutoff or the signal contact are not provided. Thus, a particularly high degree of prefabrication is achieved for different designs of the power relay.

With a view to a further simplification of installation, the coil subassembly is preferably fastened to the connector base, wherein a snap connection is preferably used for this fastening. This enables all power relay components interacting electrically and through mechanical motion to be installed outside the housing.

For the mechanical coupling of the armature to the contact bridge, an expedient embodiment of the power relay provides a coupling rod, which extends along a coil axis of the solenoid coil. The coupling rod is expediently provided with sliding support in a central part of the magnet yoke. The contact bridge is secured on the coupling rod on the side remote from the armature. In order to ensure precise guidance of the contact bridge, the coupling rod is provided in an advantageous embodiment of the invention with sliding support on its side remote from the armature (and hence in the region of the contact bridge) in the connector base. Here, the coupling rod passes through the contact bridge by means, in particular, of a bearing portion—provided with sliding support in the connector base.

In the case of electronic design variants of the power relay, the control electronics (which are present in this case) are preferably arranged outside the magnet yoke and, in this case, in particular, parallel to one of the side faces of the housing can. By means of the magnet yoke, the control electronics are here shielded from the heat arising from the flow of current through the solenoid coil. The control electronics are thus arranged in the cold region of the power relay, thereby sparing the control electronics.

In addition to single-pole embodiments with just two terminal studs and a single associated coil subassembly, multipole embodiments of the power relay are also preferably provided. These multipole embodiments of the power relay are used, in particular, to switch multiphase load circuits simultaneously or to switch single-phase load circuits in parallel by a plurality of switching units. In this context, the latter has the advantage, in particular, that the load acting on the relay during switching can be distributed between several poles. Here, multipole embodiments of the power relay are advantageously implemented by securing a plurality of coil subassemblies jointly on one and the same connector base, wherein this connector base carries two terminal studs for each coil subassembly.

In order to be able to implement different installation positions with one and the same design of the power relay, the housing can preferably bears a respective mounting surface both on a side face and on the bottom thereof, the mounting surface being provided with screw openings to receive fastening screws. The power relay can be mounted by screw fastening on each of these mounting surfaces either directly or—to allow adaptation to different hole spacings in the installation environment—via adapter plates. The screw openings provided in each of the mounting surfaces of the housing can are preferably implemented by threaded sleeves made of metal, which are press-fitted in openings of the plastics material of the housing can or are encapsulated by the material of the housing can.

In an advantageous development of an electronic design variant of the power relay, the control electronics provided in this case are provided with a contact cleaning function. For this purpose, the control electronics in this arrangement are configured to activate the solenoid coil several times at short time intervals in a contact cleaning mode. By the multiple activation, artificial contact bounce, during which the contact bridge strikes against the terminal studs several times, is thus produced. In this way, any contaminants adhering to the contact points are rubbed away, thereby achieving or maintaining low contact resistances. In a particularly advantageous embodiment of this contact cleaning function, the control electronics effect the contact cleaning only when there is no electric voltage across the terminal studs, with the result that the artificial contact bounce takes place under no load. In this way, switching arcs during the contact cleaning function are excluded.

In the electronic designs of the power relay, the control electronics are preferably connected to the terminal studs. In this case, the control electronics are designed to pick off the electric voltage drop across the terminal studs and to detect it by measurement. A supply voltage for the control electronics is furthermore preferably picked off via the terminal studs.

Other features which are considered as characteristic for the invention are set forth in the appended claims.

Although the invention is illustrated and described herein as embodied in a power relay for a vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Corresponding parts are always provided with the same reference signs in all the figures.

Figure 1:
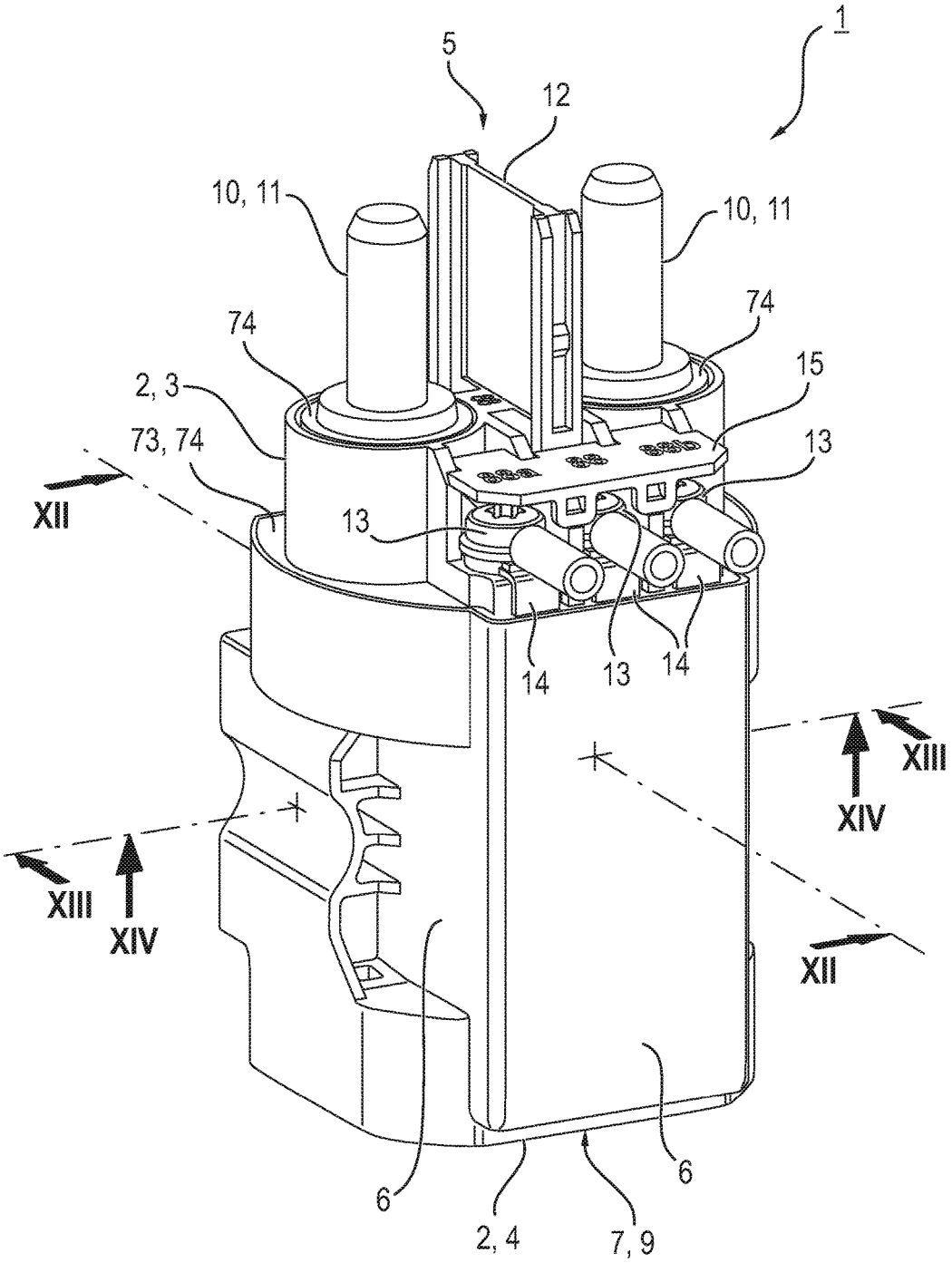
FIG. 1 is a diagrammatic, perspective view of a power relay for a heavy goods vehicle from above.
Figure 2:
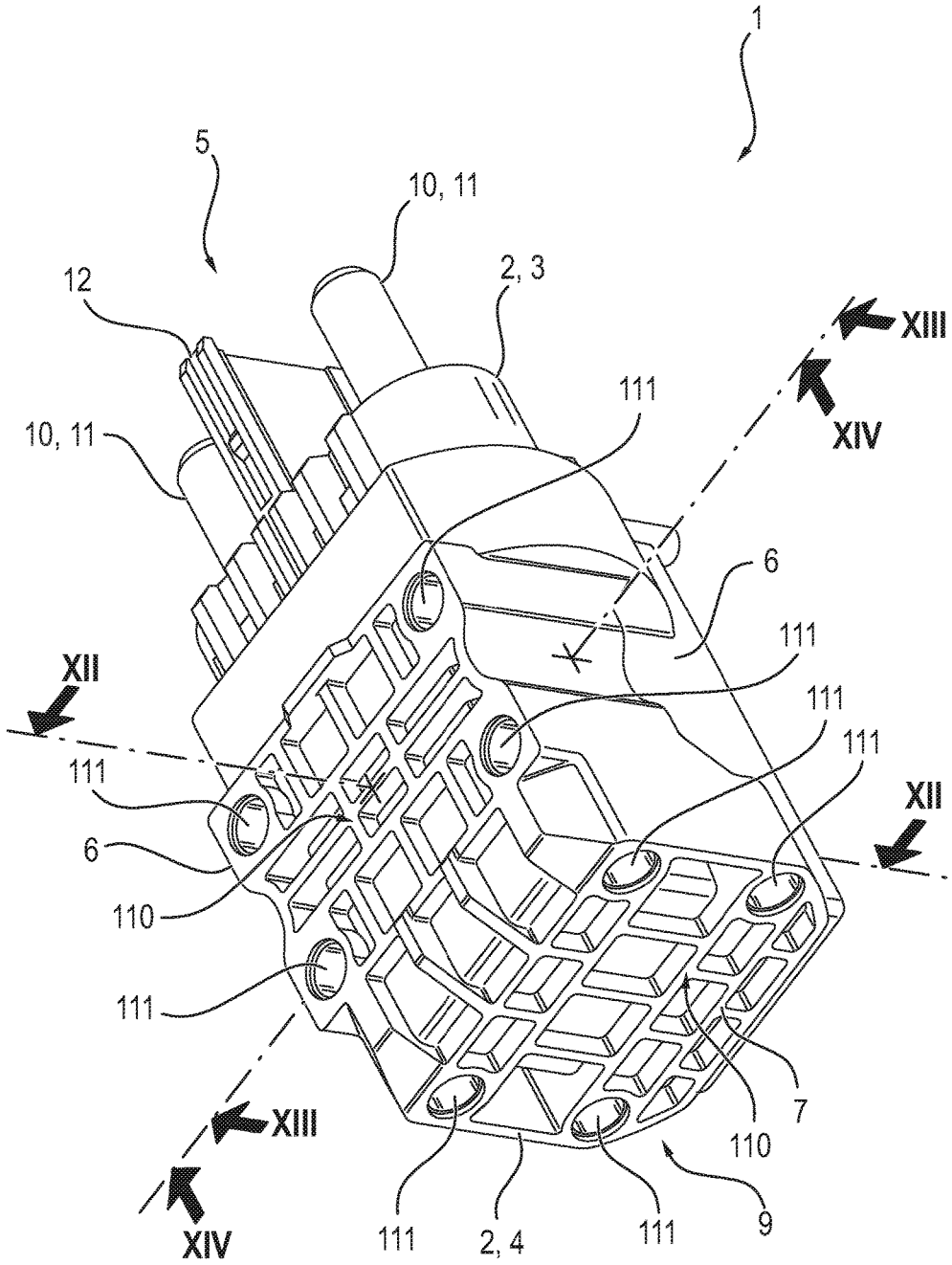
FIG. 2 is a perspective view of the power relay from below.

Referring now to the figures of the drawings in detail and first, particularly to FIGS. 1 and 2 thereof, there is shown a power relay 1 shown as a whole in the figures and contains a housing 2, which is formed by two parts, namely a connector base 3 and a housing can 4. Both the connector base 3 and the housing can 4 are here formed as injection molded components made of plastics.

The connector base 3 delimits the housing 2 in the direction of a connection side, on which the power relay 1 can be brought into contact with an external load circuit and with external control lines. The connection side is also referred to below as the upper side 5—irrespective of the actual orientation of the power relay 1 in the surrounding space. With four side walls 6 and a housing bottom 7, the housing can 4 surrounds the remaining sides of an approximately cuboidal housing interior 8 (see FIGS. 12 to 14). In this arrangement, the housing bottom 7 closes off the housing 2 on an underside 9 remote from the upper side 5 (wherein the term "underside" is also used irrespective of the actual orientation of the power relay 1 in the surrounding space).

To connect two connecting leads to the load circuit to be connected, two solid terminal studs 10, each of which projects outward with a threaded stem 11 from the housing 2, are fixed in the connector base 3. The terminal studs 10 are solid turned parts made of metal, which have a diameter of 0.8 cm in the region of the threaded stem 11, for example. To connect the respective connecting lead of the load circuit, a cable lug on the end of this connecting lead is placed on the associated threaded stem 11 and screwed into contact by a screw nut (contact nut). As an alternative, however, the terminal studs 10 can be formed by sleeves, each having a threaded hole. In this case, contact nuts are replaced by contact screws for bringing the connecting leads into contact, the contact nuts being screwed into threaded holes. As is apparent especially from FIG. 13, the terminal studs 10 are fixed in the connector base 3 by overmolding with the plastics material of the connector base 11.

In order to exclude an electric arc or some other short circuit between the terminal studs 10 and the load-circuit connecting leads that may be secured thereon, a partition wall 12, which projects into the interspace formed between the terminal studs 10, is molded onto the outside of the connector base 3.

To activate the power relay 1, i.e. to trigger switching processes, by which the power relay 1 is switched on—by establishing an electrically conductive connection within the housing between the terminal studs 10—or switched off—by breaking this electrically conducting connection—a plurality of signal terminals 13 (in this case three, by way of example), via which three corresponding external control lines can each be screwed into contact with the power relay 1 by means of respective cable lugs at the ends thereof, are furthermore formed on the connector base 3. Each signal terminal 13 is electrically connected to the housing interior 8 by a connecting conductor 14 in the form of a bent sheet metal stamping. In this arrangement, the connecting conductors 14 are inserted between the connector base 3 and the housing can 4 or are likewise held in the connector base 3 by over molding. Toward the upper side 5, the signal terminals 13 are protected from being touched by a separate plastic cover 15 that can be latched on.

Figure 3:
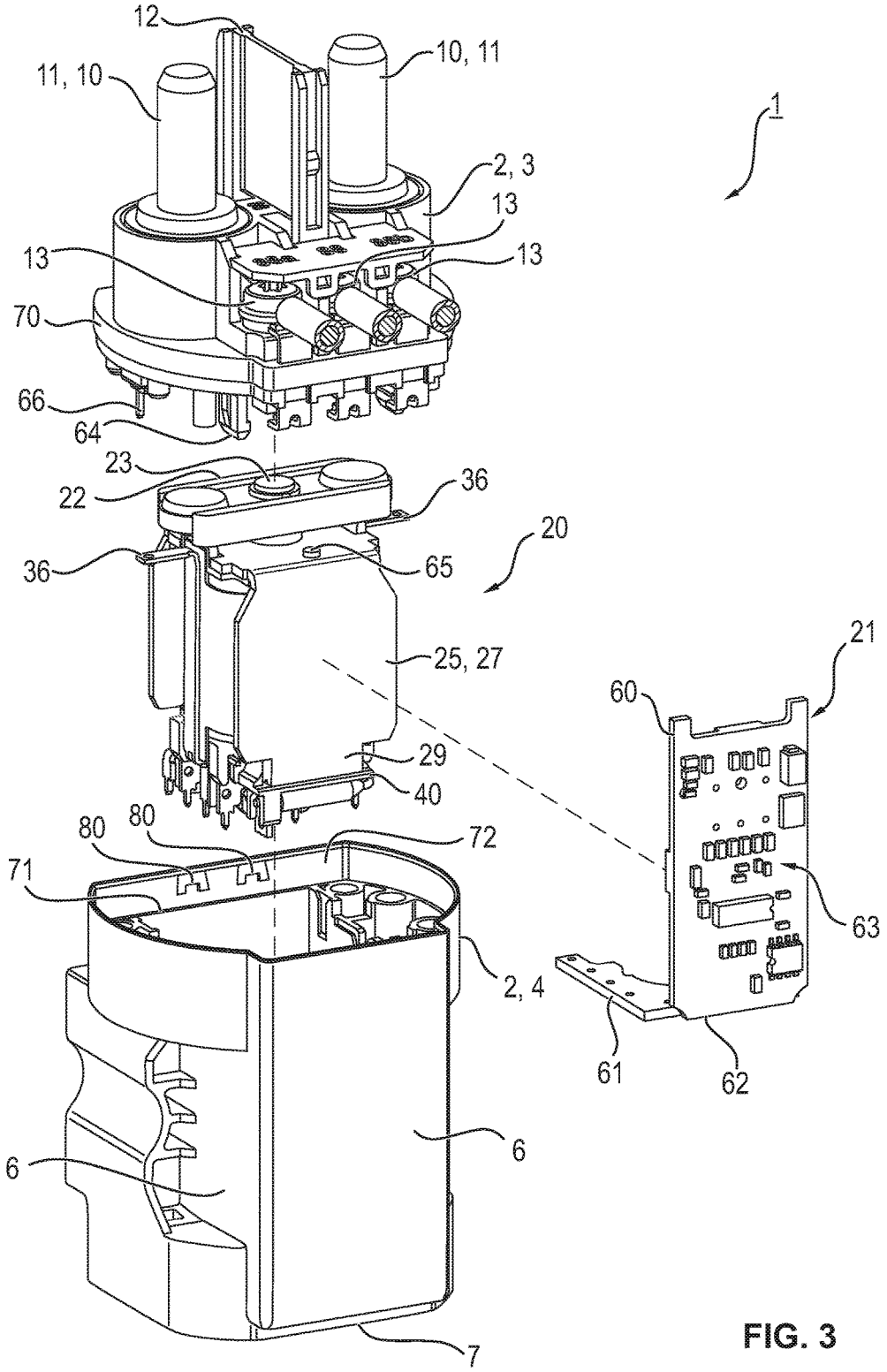
FIG. 3 is an exploded perspective view of four component subassemblies of the power relay, namely a connector base, a housing can, a coil subassembly and a circuit board carrying control electronics.

FIG. 3 shows the power relay 1 in a partially disassembled state. From this illustration, it is apparent that the power relay 1 is formed by four subassemblies, each being self-contained. Apart from the housing parts already described, namely the connector base 3 with the terminal studs 10 and signal terminals 13 secured thereon and apart from the housing can 4, the power relay 1 accordingly has a coil subassembly 20 and a conductor support, referred to below as a circuit board 21.

Figure 4:
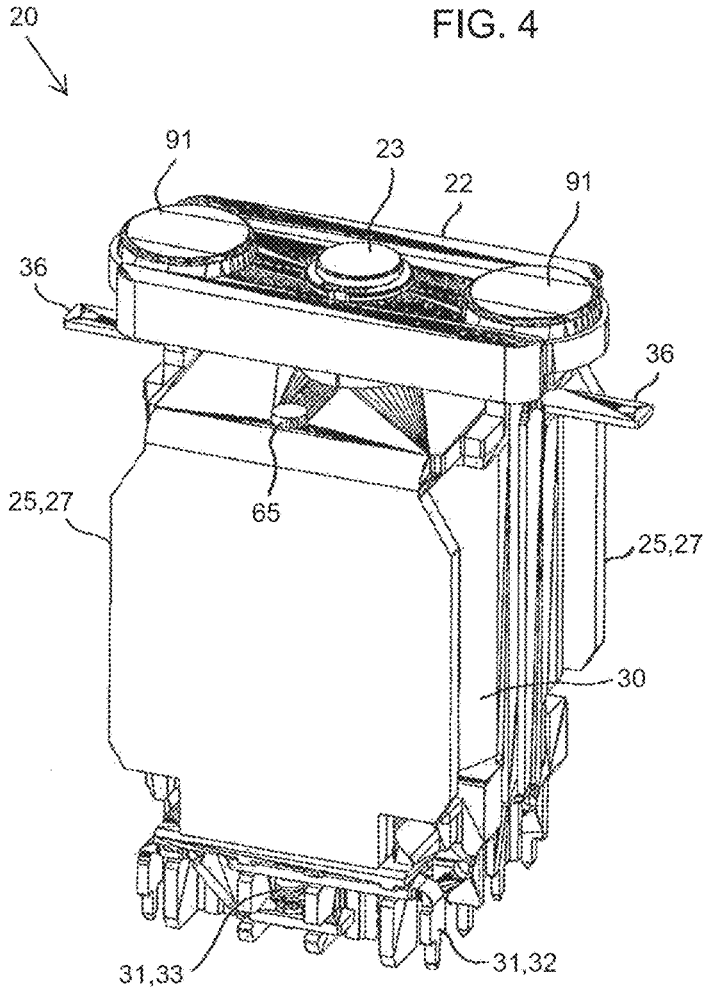
FIG. 4 is a top, perspective view of the coil subassembly of the power relay.
Figure 6:
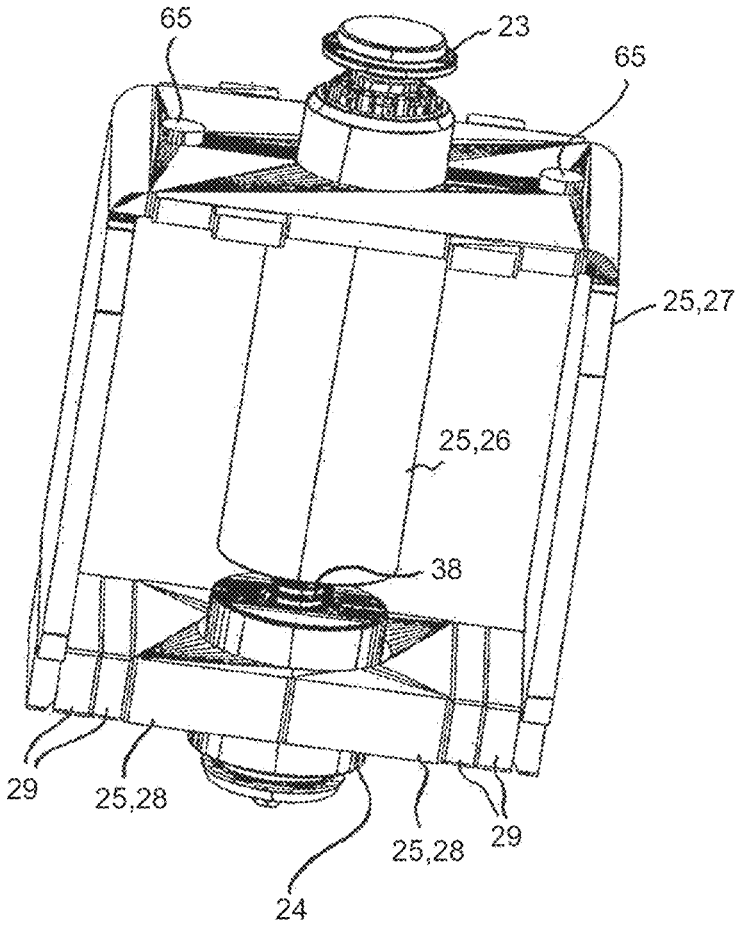
FIG. 6 is a top, perspective view of a magnetic circuit of the power relay with a magnet yoke and an armature and with a coupling rod, via which the armature acts on a contact bridge (not shown here)

The coil subassembly 20, which is shown on an enlarged scale in FIG. 4, contains a contact bridge 22, which is coupled mechanically by a coupling rod 23 to an armature 24 of a magnetic circuit, which is shown separately in FIG. 6. As can be seen especially from this illustration, the magnetic circuit contains, in addition to the armature 24, a magnet yoke 25, wherein the magnet yoke 25 is formed by a central hollow-cylindrical core 26 concentrically surrounding the coupling rod 23, a hoop 27 bent into a U shape, and two pole shoes 28 extending toward one another from the ends of the legs of the hoop. In this arrangement, the pole shoes 28 enclose the armature 24 between them. The armature 24 and the component parts of the magnet yoke 15 are formed from ferromagnetic material.

In the illustrative embodiment shown, the power relay 1 is a bistable relay. In this case, two plate-shaped permanent magnets 29 are arranged between the pole shoes 28 and each of the ends of the legs of the hoop 27. However, depending on the design of the power relay 1, one or two of the permanent magnets 29 associated with a pole shoe 28 can also be replaced here by ferromagnetic plates of the same size. In the case of a monostable variant (not shown specifically) of the power relay 1, the permanent magnets 29 are completely replaced by ferromagnetic material.

As the component part which gives its name to the device, the coil subassembly 20 contains a solenoid coil 30 (FIG. 4), which lies in the volume framed by the magnet yoke 25. In this arrangement, the solenoid coil 30 surrounds the core 26 of the magnet yoke 25 concentrically and, for its part, is framed by the hoop 27 and the pole shoes 28.

Figure 5:
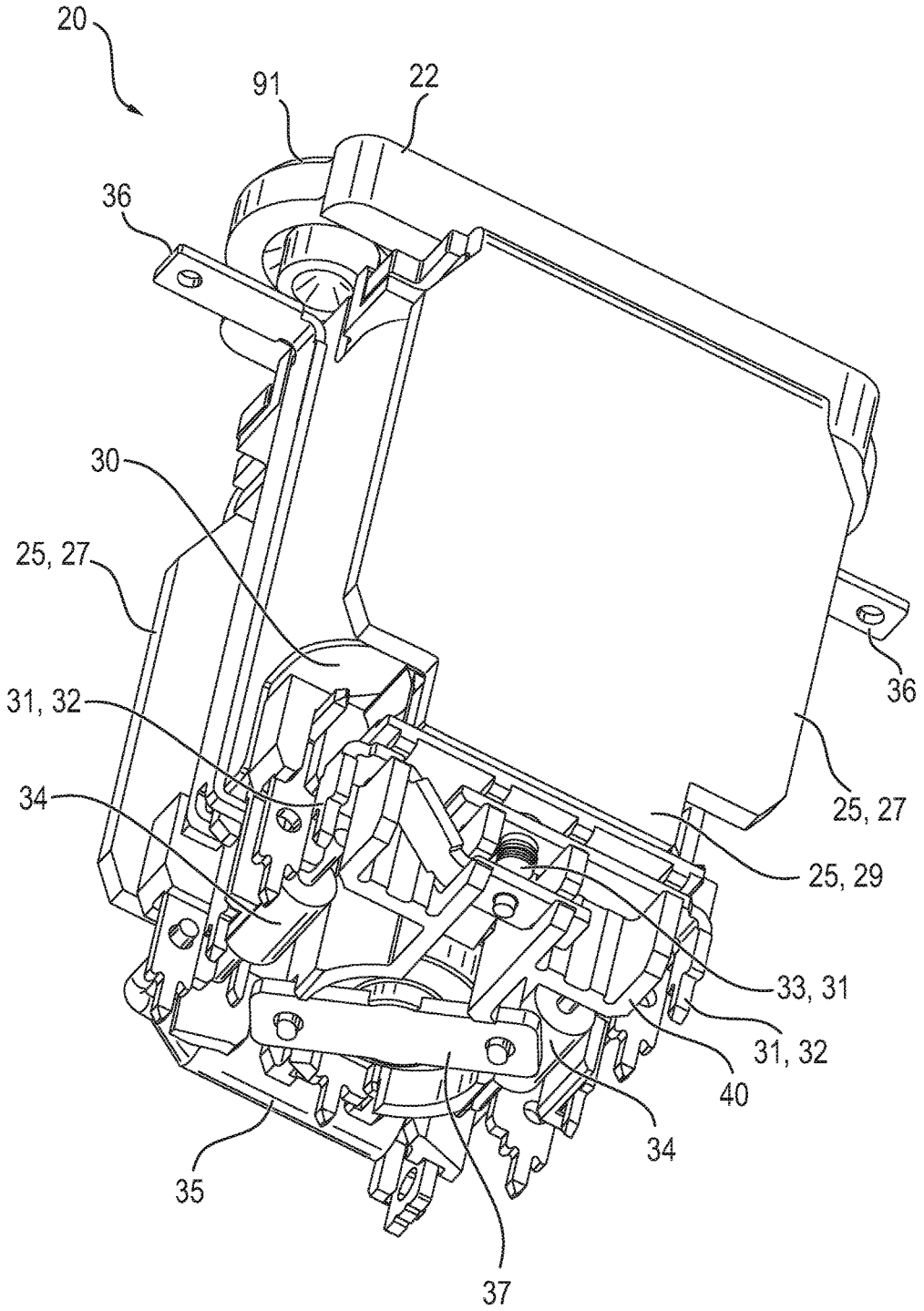
FIG. 5 is a bottom, perspective view of the coil subassembly according to FIG. 4.

As is apparent especially from FIG. 5, the coil subassembly 20 furthermore contains a number of electric functional elements, namely a switching position contact 31 having two fixed contacts 32 and a moving contact 33 coupled to the coupling rod 23, two freewheeling diodes 34, which are used to provide protection against inductive voltage surges during switching, and a thermal cutoff 35, which brings about forced switching off of the power relay 1 in the event of overheating.

Figure 12:
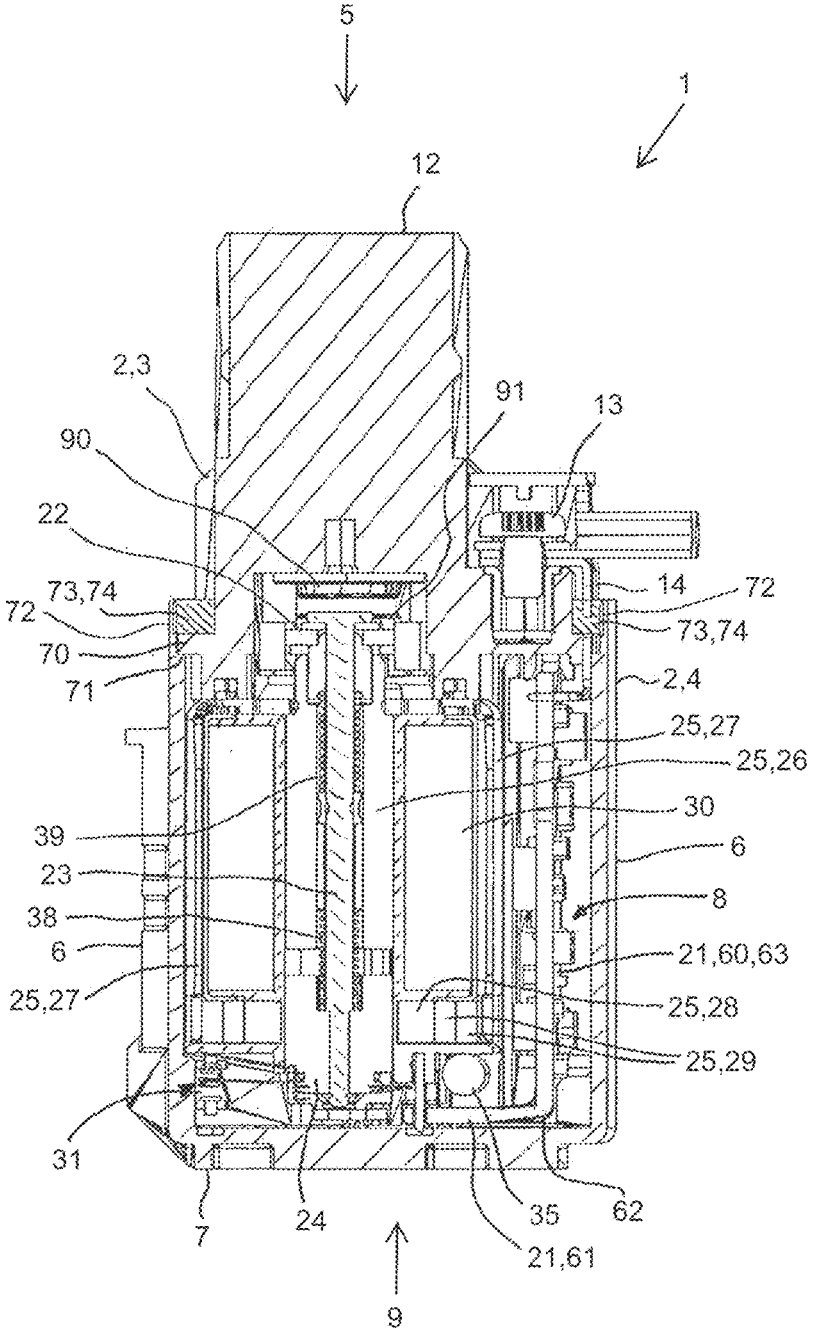
FIG. 12 is a longitudinal sectional view of the power relay taken along the longitudinal sectional line XII-XII shown in FIGS. 1 and 2.
Figure 13:
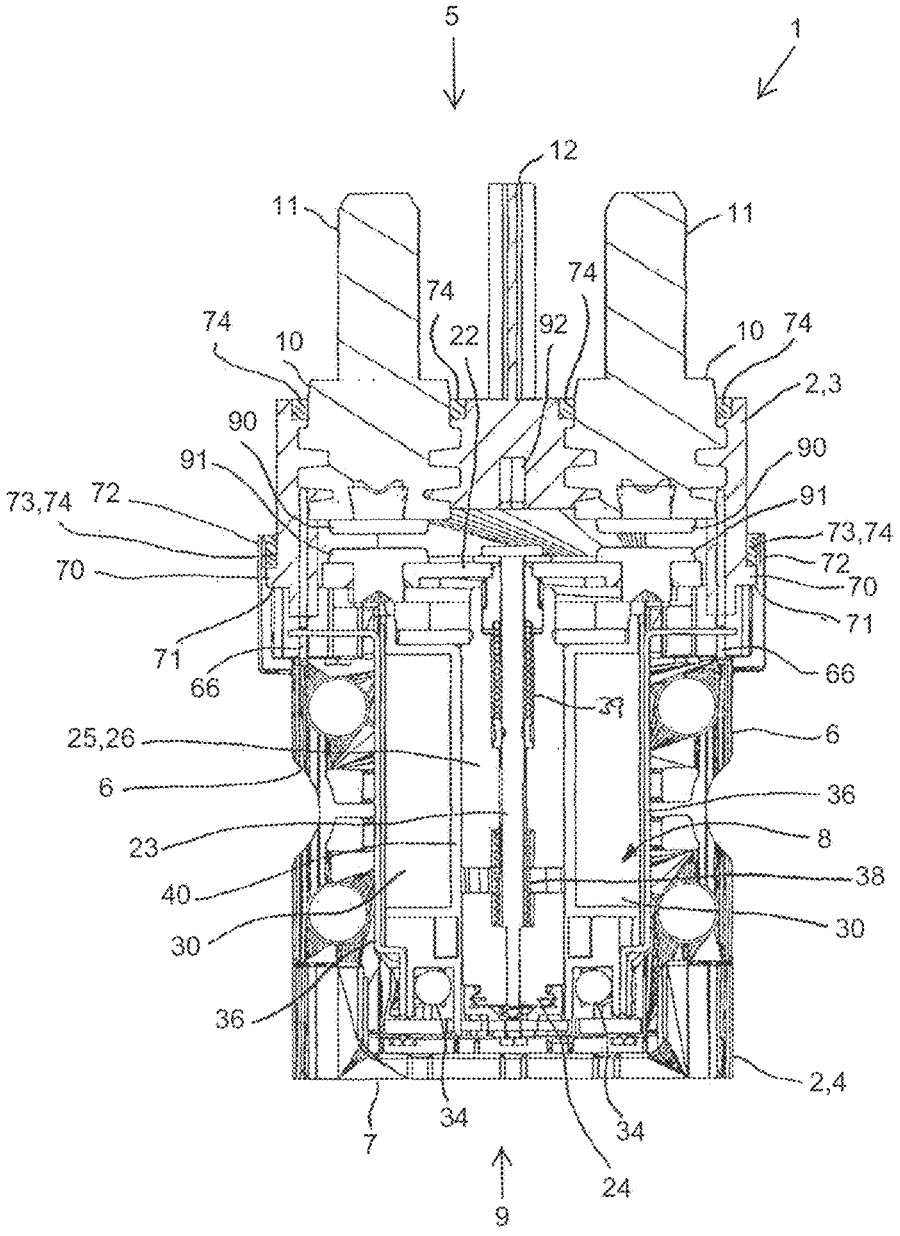
FIG. 13 is a longitudinal sectional view of the power relay according to taken along the longitudinal section line XIII-XIII shown in FIGS. 1 and 2.

The coil subassembly 20 furthermore contains two auxiliary conductors 36, which are each formed by a bent sheet metal stamping, a damping element 37 and two compression springs surrounding the coupling rod 23, namely a return spring 38 and a contact pressure spring 39 (see FIGS. 12 and 13).

Figure 7:
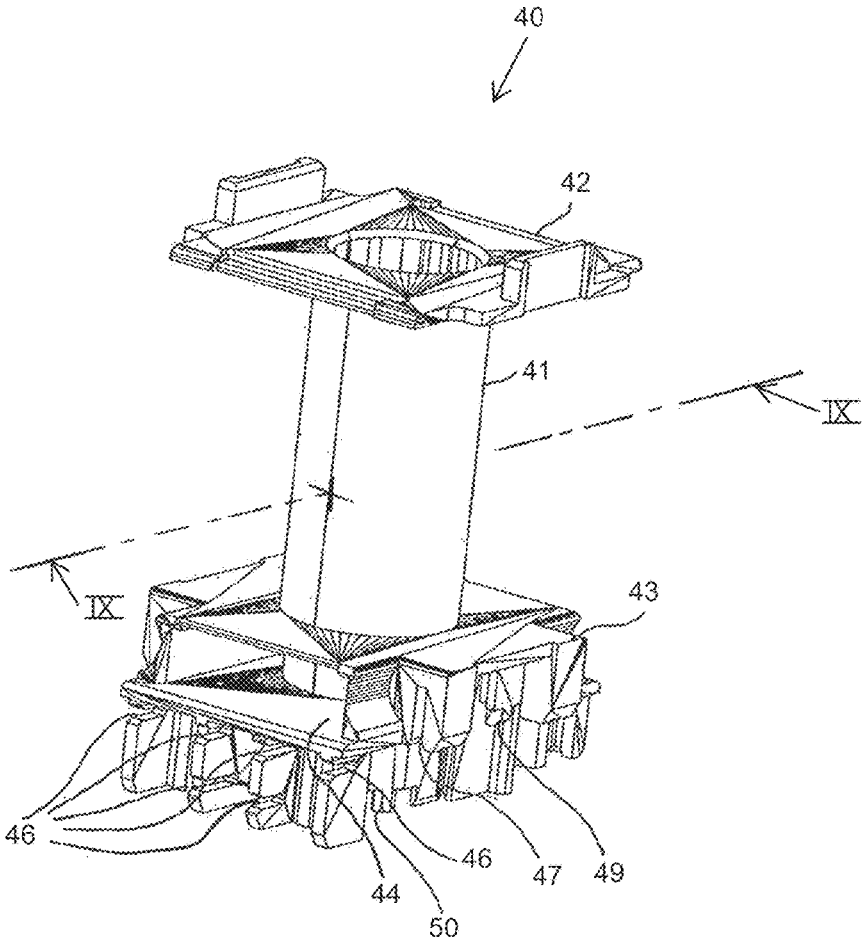
FIG. 7 is a top, perspective view of a support body of the coil subassembly.
Figure 8:
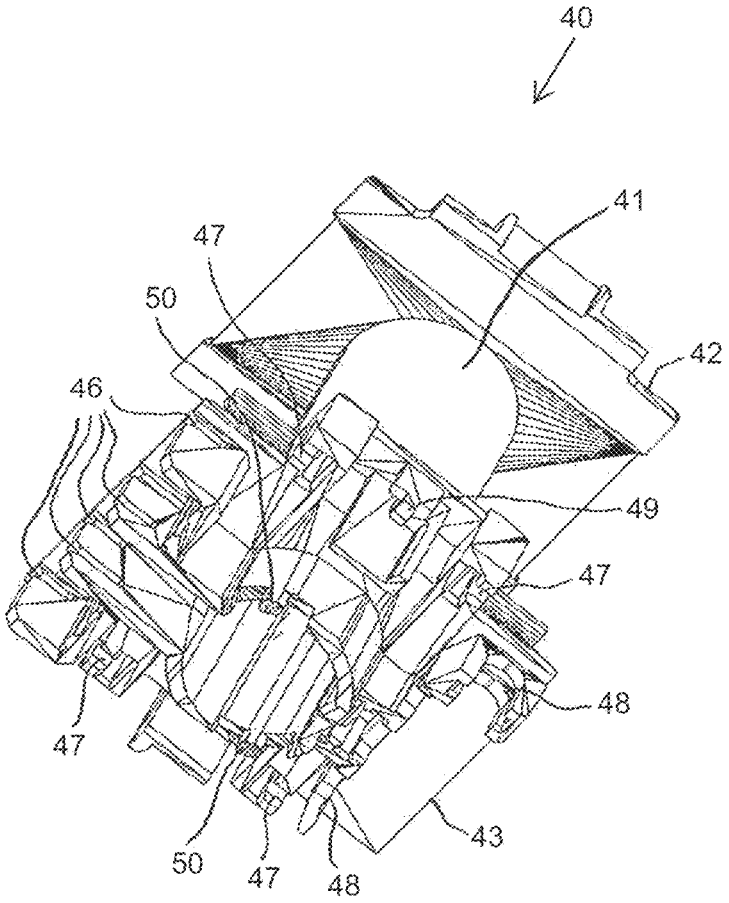
FIG. 8 is a bottom perspective view of the support body according to FIG. 7.
Figure 9:
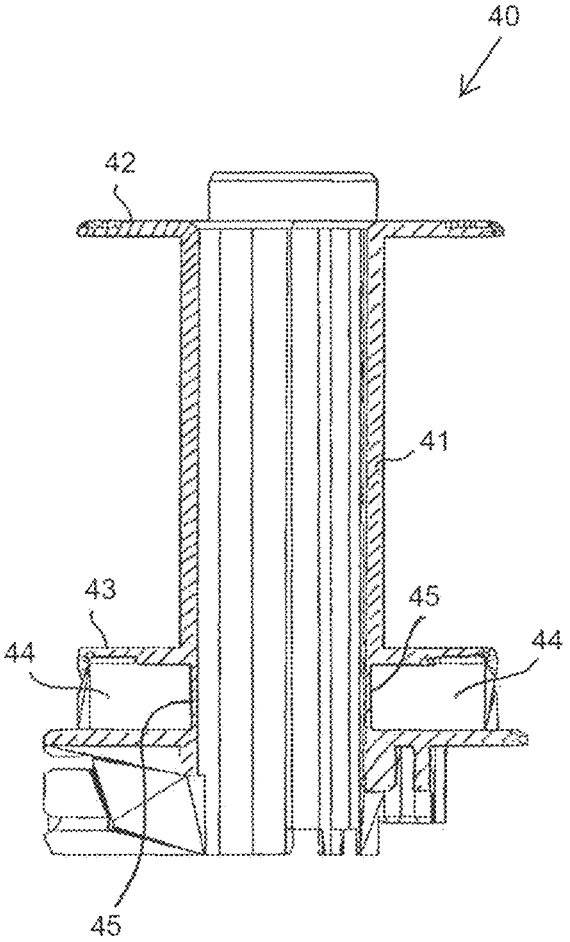
FIG. 9 is a cross-sectional view of the support body taken along the cross section line IX-IX shown in FIG. 7.

Here, the above-listed component parts of the coil subassembly 20 are held together mechanically by a support body 40, which is shown in isolation in FIGS. 7 to 9. The support body 40 is an integral, multifunctional injection-molded component made of plastics.

On the one hand, the support body 40 supports the solenoid coil 30, which, for this purpose, is wound directly onto a central column 41 of the support body 40. On the other hand, the support body 40 holds the magnet yoke 25 and the armature 24. For this purpose, the armature 24 and the core 26 of the magnet yoke 25 are accommodated in the interior of the hollow column 41 of the support body 40 (see FIGS. 12 to 14). In this arrangement, the armature 24 is provided with sliding support directly on the support body 40. The hoop 27 of the magnet yoke 25 is placed on an upper platform 42 of the support body 40, with the result that its legs project downward laterally outside the solenoid coil 30. The pole shoes 28 and the permanent magnets 29 of the magnet yoke 25 lie in two pockets 44 formed at the opposite end in a lower platform 43 of the support body 40. As is apparent especially from FIG. 9, each of the two pockets 44 is delimited on the inside—and thus toward the hollow interior of the column 41—by a thin wall 45 of the support body 40, which has a defined wall thickness of 0.3 mm, which is constant at all points. In this arrangement, the walls 45 establish a defined gap width between the magnet yoke 25 and the armature 24.

As can be seen especially from FIG. 8, the support body 40 furthermore has:

a) holders 46 for the fixed contacts 32 of the switching position contact 31;
b) installation space 47 for the freewheeling diodes 34 (in the illustrative embodiment shown, the freewheeling diodes 34 are held only indirectly on the support body 40 by coil connecting conductors);
c) holders 48 for the thermal cutoff 35;
d) holders 49 for the auxiliary conductors 36; and
e) holders 50 for the damping element 37.

In accordance with the intended purpose, identical support bodies 40 are used here for different designs of the power relay 1. The support body 40 thus has the respectively molded-on holders 46 to 50 even if not all the functional components described above (i.e. the switching position contact 31, the freewheeling diodes 34, the thermal cutoff 35, the auxiliary conductors 36 or the damping element 37) are present in a particular design of the power relay 1.

The circuit board 21 shown in FIG. 3 is formed by the two sections 60 and 61, which are connected to one another in an articulated manner by a film hinge 62 and can therefore be bent out of a planar original state into the L-shaped arrangement shown in FIG. 3. In the electronic design shown of the power relay 1, section 60 carries control electronics 63. Section 61 primarily contains contact points for electrically contacting the fixed contacts 32 of the switching position contact 31, the coil connections with the freewheeling diodes 34, the thermal cutoff 35, the auxiliary conductors 36 and the solenoid coil 30.

In the case of purely electromechanical designs of the power relay 1, the circuit board 21 is optionally likewise present. In this case, however, it does not carry any control electronics 63 but only conductor tracks for bringing the solenoid coil 30 and the electric functional elements that may be present into contact with the signal terminals 13. As an alternative, the circuit board 21 is replaced by wire conductors in purely electromechanical designs of the power relay 1.

In the course of assembling the power relay 1, the support body 40 is first of all fitted with the solenoid coil 30, the magnet yoke 25, the armature 24 connected to the coupling rod 23, and the compression springs 38, 39, the contact bridge 22 and the electric functional components (i.e. the switching position contact 31, the freewheeling diodes 34, the thermal cutoff 35 and/or the auxiliary conductors 36) that may be present, and the damping element 37. The coil subassembly 20 is thus prepared as an inherently stable (self-supporting) modular unit.

In this form, the coil subassembly 20 is clipped from below onto the connector base 3, which has been produced in advance in an injection molding process. For this purpose, the connector base 3 is provided on the underside thereof with integrally molded snap hooks 64 (FIG. 3), which engage on both sides under the upper platform 42 of the support body 40. In the state of the coil subassembly 20 in which it is secured on the connector base 3, the hoop 27 of the magnet yoke 25 furthermore engages positively by two molded projections 65 (FIGS. 3 and 4) in depressions of complementary shape on the underside of the connector base 3. In the clipped-on state, the hoop 27 of the magnet yoke 25 is thus connected nonrotatably to the connector base 3 in respect of a rotation about the axis of the solenoid coil or the respective axis of the terminal studs 10.

After, before or simultaneously with the clipping on of the coil subassembly 20, the circuit board 21 is installed. For this purpose, connection points in the region of section 60 are, on the one hand, soldered to the connecting conductors 14 of the signal terminals 13. On the other hand, connection points in the region of section 61 are soldered to terminals of the solenoid coil 30 and of the electric functional elements present (that is to say optionally the fixed contacts 32 of the switching position contact 31, the freewheeling diodes 34, the thermal cutoff 35 and/or the auxiliary conductors 36). In the installation position thereof, section 60 of the circuit board 21 extends parallel to one leg of the hoop 27, wherein section 60 is arranged outside the hoop 27. Section 61 of the circuit board 21 extends perpendicularly to the coil axis, wherein it reaches under the magnet yoke 25 and the armature 24.

The auxiliary conductors 36 are furthermore soldered to (voltage pickoff) terminals 66 (FIGS. 3 and 13). In this arrangement, the terminals 66 are associated in pairs with the terminal studs 10. One of the terminals 66 is thus brought into contact with one of the terminal studs 10, while the other terminal 66 is brought into contact with the other terminal stud 10. For this purpose, the terminals 66 are pre-welded to the respectively associated terminal studs 10 and are overmolded together with the latter by the plastics material of the connector base 3.

After the installation of the coil subassembly 20 and of the circuit board 21 on the connector base 3, the housing can 4 is placed over the coil subassembly 20 and the circuit board 21 and latched and screwed to the connector base 3, thereby closing the housing 2. Here, the hoop 27 of the magnet yoke 25 lies in the housing can 4 in such a way that the legs thereof extend in the manner of cross members between two opposite side walls 6 of the housing can 4 and parallel to the remaining side walls 6 over the entire width of the housing interior 8. The hoop 27 is thus accommodated nonrotatably in the housing can 4 over the entire height of the latter—as measured in the direction of the coil axis and of the axis of the housing can 4. By virtue of its torsionally stable structure, the hoop 27 thus stiffens the housing can 4 in relation to axial torques of the kind which are exerted particularly when tightening the contact nuts on the terminal studs 10.

In the closed state of the housing 2, the connector base 3 rests by means of an encircling radial web 70 (see FIGS. 3, 12 and 13) on an encircling shoulder 71 (FIGS. 3, 12 and 13) in the wall of the housing can 4. In this arrangement, the housing can 4 fits around the outside of the radial web 70 of the connector base 3 by means of an encircling collar 72 delimiting its opening (FIGS. 3, 12 and 13) and projects beyond the radial web. Thus, the collar 72 surrounds the upper side of the radial web 70 like a balustrade and, together with the connector base 3, forms a trough-shaped structure—visible in FIGS. 12 and 13—which is referred to below as trough 73. For liquid and gastight sealing of the joint between the connector base 3 and the housing can 4, this trough 73 is filled with a potting compound 74, which is initially liquid and hardens in the course of a hardening phase. Here, a two component system containing an epoxy resin and an added hardener, in particular, is used as potting compound 74.

The potting compound 74 is furthermore also used to seal the leadthroughs of the connecting conductors 14. For this purpose, the connecting conductors 14 pass through the connector base 3 in the region of the trough 73. The leadthroughs of the terminal studs 10 through the connector base 3 are sealed off separately from the trough 73 by potting compound.

Figure 10:
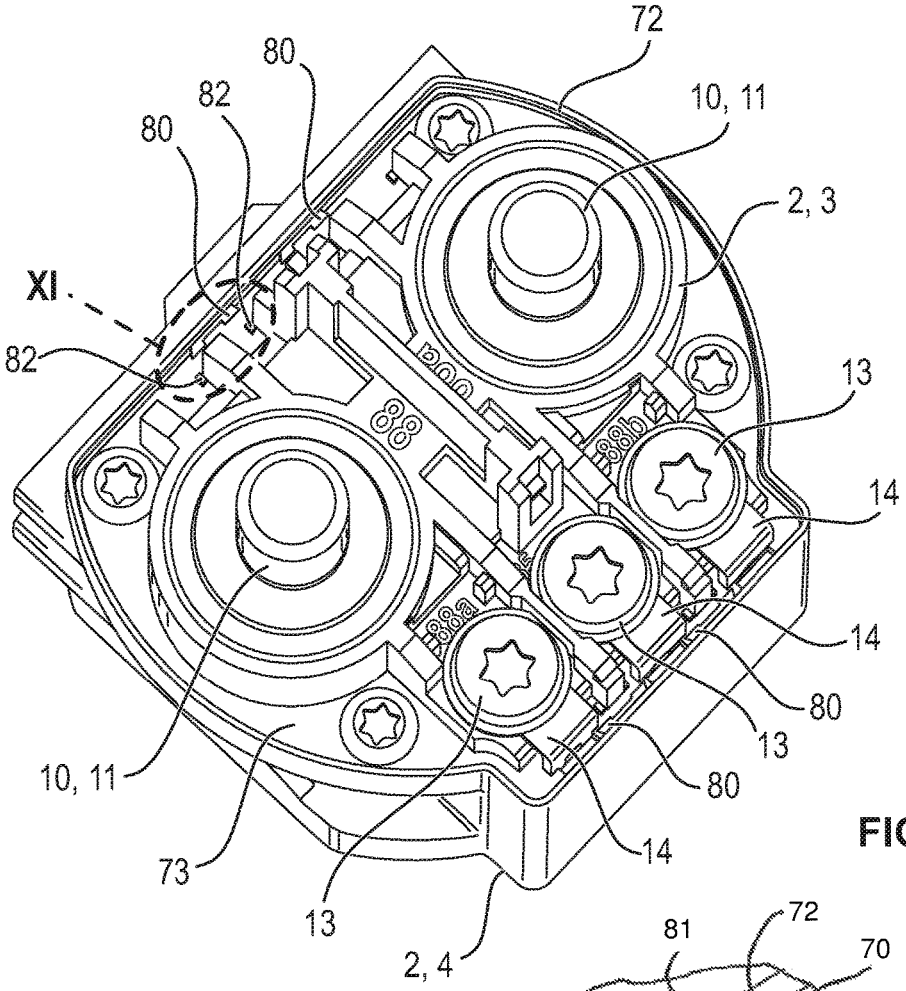
FIG. 10 is a top, perspective view of the power relay in an unencapsulated preassembly state.
Figure 11:
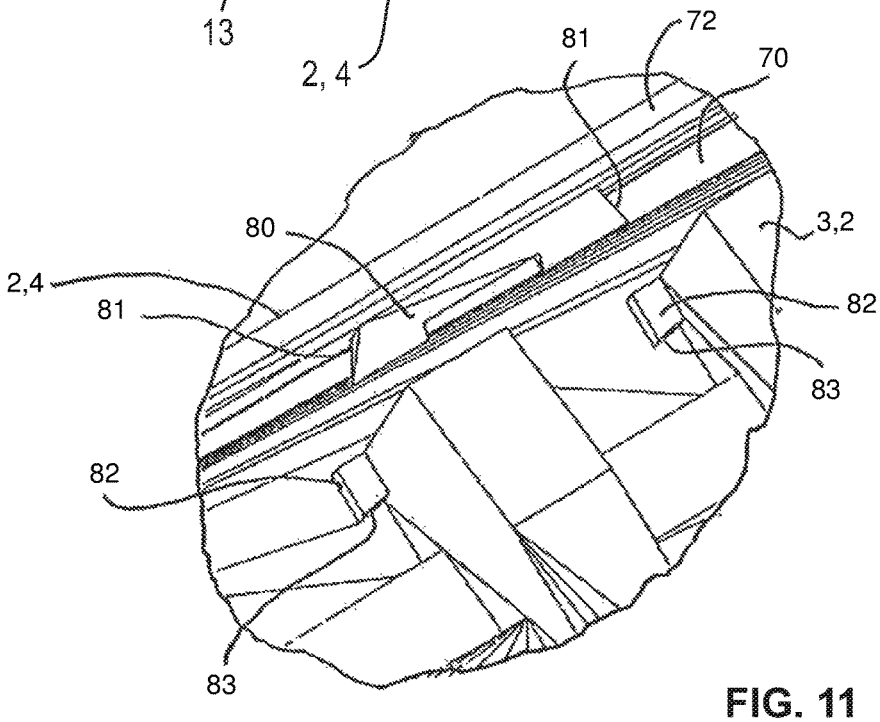
FIG. 11 is a perspective view of the housing of the power relay being an enlarged detail XI from FIG. 10.

In order to additionally secure the joint between the connector base 3 and the housing can 4, a number of radial projections 80 (see FIGS. 3, 10 and 11) is provided along the inside of the collar 72—and here, in particular, in the straight sections of the collar 72—the projections projecting inward from the inner wall of the collar 72. The radial projections 80 act, on the one hand, as latching noses, which fit around the radial web 70 of the connector base 3 and thus latch it in the installed position thereof. Moreover, each radial projection 80 is provided on each side with a respective undercut 81, with the result that each radial projection (80) has a dovetail contour when viewed from above. By virtue of the undercuts 81, the radial projections 80 interlock with the potting compound 74, thereby preventing both twisting of the housing can 4 relative to the connector base 3 and radial bulging of the side walls 6 of the housing can 4.

To prevent the potting compound 47 being taken along with the housing can 4 under the action of forces acting on the side walls 6 of the housing can 4 and, in the process, coming away from the outside of the connector base 3, a number of mating contours in the form of projections 82 are formed on the upper side of the connector base 3. In this arrangement, the respective internal edges of these projections in turn form an undercut 83, which interlocks with the potting compound 74.

In alternative designs (not shown), the power relay 1 is multipoled, in particular two-poled or three-poled. In this case, a number of coil subassemblies 20 corresponding to the number of poles is connected to a common connector base 3, wherein in each case 2 terminal studs 10 for each coil subassembly 20 are in this case fixed in the connector base 3. In this arrangement, depending on the design, a separate circuit board 21 can be provided for each coil subassembly 20 or a common circuit board can be provided for all the coil subassemblies 20. In the case of multipole designs of the power relay 1, a housing can 4—expediently subdivided by transverse walls—is preferably provided to jointly accommodate all the coil subassemblies 20.

Figure 14:
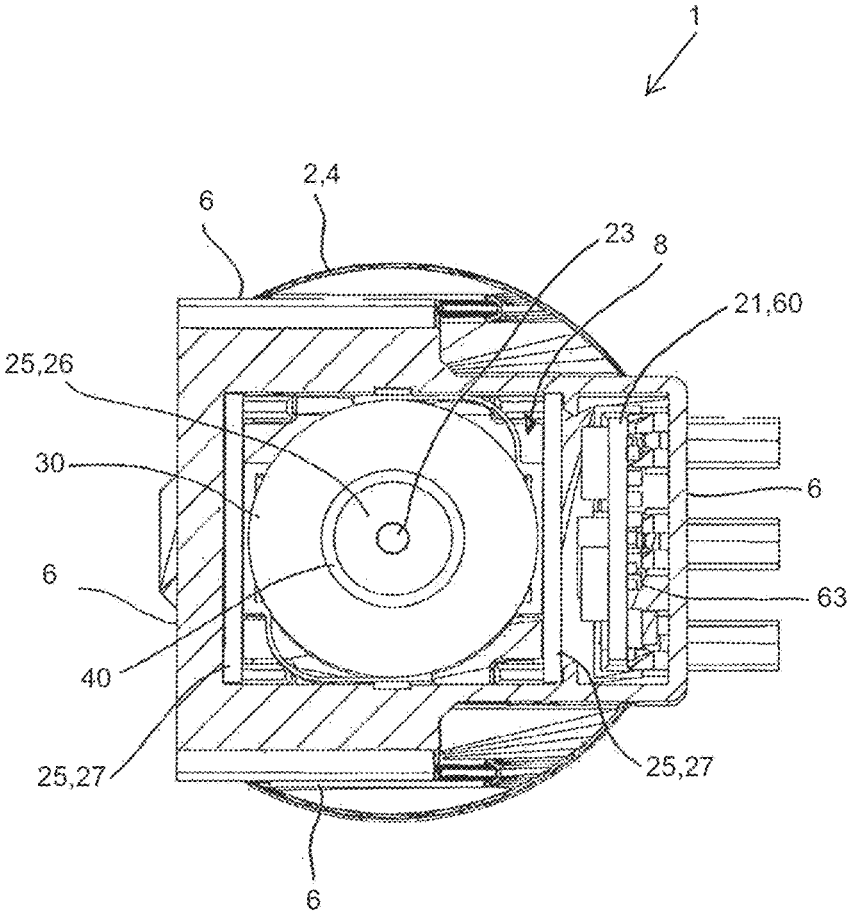
FIG. 14 is a cross-section view of the power relay taken along the cross section line XIV-XIV shown in FIGS. 1 and 2.

FIGS. 12 to 14 show the power relay 1 in the fully assembled state. It can be seen from these illustrations that the terminal studs 10 each also form fixed contacts of the main switching device of the power relay 1, the switching device being provided to switch the load circuit. For this purpose, the ends of the terminal studs 10, which project from the underside of the connector base 3 into the housing interior 8, are each provided with a contact element 90. The corresponding moving contact of the main switching device is formed by the contact bridge 22, which, for this purpose, contains a respective mating contact element 91 situated opposite each of the contact elements 90. The mating contact elements 91 are electrically short circuited within the contact bridge 22.

FIGS. 12 and 13 show the power relay 1 in an open position, in which the mating contact elements 91 have been raised from the contact elements 90 (moved out of contact), with the result that there is no electrically conducting connection between the terminal studs 10. To switch on the power relay 1, the solenoid coil 30 is energized. This produces a magnetic flux in the magnet yoke 25, thereby pulling the armature 24 against the core 26 of the magnet yoke 25. By means of the armature 24, the contact bridge 22 is deflected upward during this process via the coupling rod 23, with the result that the mating contact elements 91 strike against the corresponding contact elements 90. In the closed position of the power relay 1 produced in this way, a conducting connection is formed between the terminal studs 10 via the contact bridge 22.

To switch off the power relay 1, the solenoid coil 30 is energized with a reverse polarity. Under the action of the magnetic flux produced during this process in the magnet yoke 25, the holding force produced by the permanent magnets 29 is compensated, with the result that the armature 24 is pulled away from the core 26 by the return spring 38 and thus pressed into the open position shown in FIGS. 12 and 13. In this case, the armature 24 once again takes along the contact bridge 22 via the coupling rod 23, as a result of which the mating contact elements 91 are moved out of contact with the corresponding contact elements 90, breaking the electric connection between the terminal studs 10. The damping element 37 mounted on the lower end of the support body 40 absorbs this movement and thus prevents the unit formed by the armature 24, the coupling rod 23 and the contact bridge 22 from springing back in the direction of the closed position. In addition, the damping element 37 reduces the play of the components of the coil subassembly 20.

In the illustrated bistable design of the power relay 1, each of the two switching positions of the power relay 1 is stable, even in the deenergized state of the solenoid coil 30. Here, the solenoid coil 30 need only be energized temporarily.

In a design variant (not shown explicitly) of the power relay 1, a bearing section of the coupling rod 23 projects upwards, i.e. beyond the side of the contact bridge 22 remote from the armature. Here, the bearing section enters a bearing opening 92 in the connector base 3, the bearing opening being arranged in alignment, thus ensuring that the coupling rod 23 is also provided with sliding support in the connector base 3. Particularly stable and precise positioning of the contact bridge 22 is thereby ensured.

As is apparent especially from FIG. 12, section 60 of the circuit board 21 is arranged between one leg of the group 27 and the adjacent side wall 6 of the housing can 4 in the assembled state of the power relay 1. The control electronics 63 arranged on section 60 are thus shielded thermally by the hoop 27 from the heat arising when the solenoid coil 30 is energized. Consequently, the control electronics 36 are situated in a cold region of the housing 2, thereby preventing premature aging of the control electronics 63.

The activation of the solenoid coil 30 is accomplished either directly via the signal terminals 14 or via the control electronics 63, which, for their part, are supplied with power via the terminals 66 and the auxiliary conductors 36 in the illustrative embodiment shown. The control electronics 63 activate the solenoid coil 30 in accordance with external or internal control commands, which are supplied to the control electronics 63 via the signal terminals 13. Via terminals 66, the control electronics 63 furthermore determine the voltage drop across the terminal studs 10 in the switched-on state of the power relay 1 as a measure of the load current flowing through the power relay 1 or to detect the relay position. In this case, the control electronics 63 optionally effect overload switch-off and short circuit switch-off by moving the power relay 1 automatically into the open position if the load current detected exceeds predetermined threshold values. In the case of multipole designs of the power relay 1, the control electronics 63 optionally also evaluate, by comparison, the respective voltage drops across the terminal studs 10 of the individual poles in order to switch off the power relay 1—depending on the design—when a fault current or an asymmetrical current distribution is detected.

Finally, the control electronics 63 optionally have a contact cleaning function. In a corresponding contact cleaning mode, the control electronics 63 successively activate the solenoid coil 30 several times at regular short time intervals, producing an artificial contact bounce. In this process, the contact bridge 22 strikes several times against the terminal studs 10, as a result of which contaminants possibly adhering to the contact elements 90 and the mating contact elements 91 are rubbed off. During this process, the control electronics 63 first of all check the electric voltage applied across the terminal studs 10 and switch to the contact cleaning mode only if this voltage is negligible and the power relay 1 can thus be switched under no load.

Particularly when the power relay 1 is switched off in the case of an overload or short circuit, the heating of the current-carrying parts and a switching arc which forms generally lead to a high excess pressure in the housing interior 8. Under unfavorable circumstances, this excess pressure can assume a value which jeopardizes the stability of the housing 2, in particular of the housing can 4 or of the joint between the connector base 3 and the housing can 4. In order to prevent explosion or uncontrolled bursting of the housing 2 under these circumstances, the housing can 4 is therefore provided with an excess pressure safeguard 100.

Figure 15:
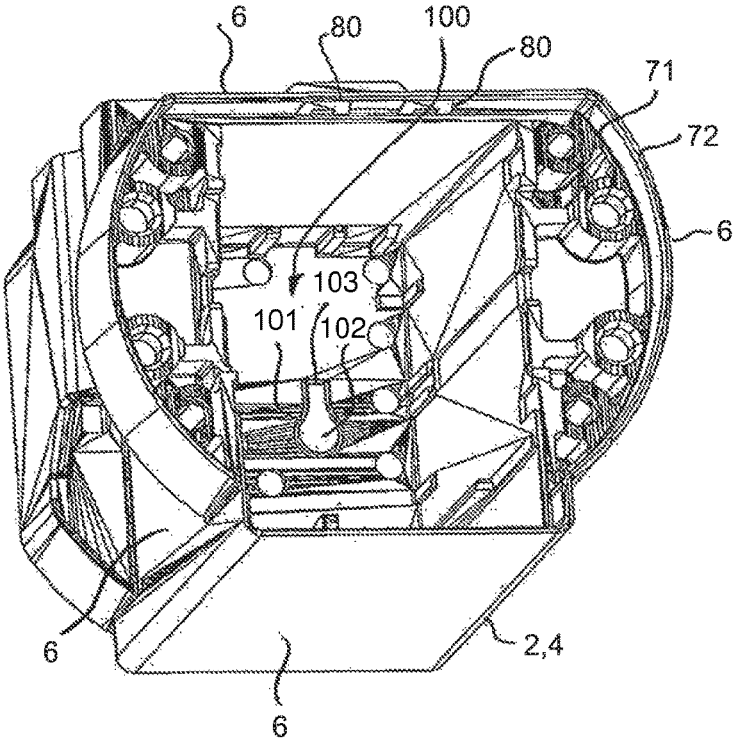
FIG. 15 is a top, perspective view of the housing can of the power relay.

As can be seen from FIG. 15, this excess pressure safeguard 100 is formed by a curved groove, which locally reduces the thickness of the material of the housing bottom 7 and thereby acts as a predetermined breaking point 101. The predetermined breaking point 101 delimits an approximately keyhole-shaped tab 102 from the housing bottom 7 on three sides. Extending between the ends of the predetermined breaking point 100 and thus at the narrow end of the keyhole-shaped tab 102 is a further groove, which has a shallower groove depth than the predetermined breaking point 101 and therefore acts as a film hinge 103. The predetermined breaking point 101 is dimensioned in such a way that it bursts open if the pressure in the housing interior 8 exceeds a critical limit value of, for example, about 2 to 3 bar. In this case, the tab 102 is bent open upward around the film hinge 103 and thus exposes a gas expulsion opening, via which a pressure equalization with the environment takes place.

In a preferred embodiment of the power relay 1, an electric signal line (not shown explicitly) in the form of a vapor deposited or adhesively bonded conductor track, the electric volume resistivity of which is interrogated by the control electronics 36, is placed on the inner wall of the housing bottom 7, transversely across the predetermined breaking point 101 and the tab 102. In this arrangement, the signal line is automatically severed when the predetermined breaking point 100 bursts, this being detected by the control electronics 63 on the basis of the sudden increase in volume resistivity. In this case, the control electronics 63 transfer the power relay 1 to a safe state. In a design variant which is expedient for many applications, the control electronics 63 trigger a permanent forced switch off of the power relay 1 in order to enforce replacement of the power relay 1.

As is apparent from FIG. 2, two alternative assembly possibilities are predetermined for the power relay 1. Thus, the housing can 4 bears a respective mounting surface 110 on the outside both on one side wall 6 and on the housing bottom 7. Four screw openings 111 are made in each mounting surface 110, in which openings the power relay 1 can be mounted by corresponding fastening screws, either directly or via an interposed adapter plate, depending on the intended purpose. The screw openings 101 are preferably formed by threaded sleeves made of metal, which are press-fitted or screwed into associated depressions (blind holes) in the plastics material of the housing can 4 or which are over molded with the plastics material.

The invention will be particularly clear from the illustrative embodiments described above but is nevertheless not restricted to these illustrative embodiments. On the contrary, numerous further embodiments of the invention can be derived from the claims and the above description.

The following is a summary list of reference numerals and the corresponding structure used in the above description of the invention:

1 power relay
2 housing
3 connector base
4 housing can
5 upper side
6 side wall
7 housing bottom
8 housing interior
9 underside
10 terminal stud
11 threaded stem
12 partition wall
13 signal terminal
14 connecting conductor
15 cover
20 coil subassembly
21 circuit board
22 contact bridge
23 coupling rod
24 armature
25 magnet yoke
26 core
27 hoop
28 pole shoes
29 permanent magnet
30 solenoid coil
31 switching position contact
32 fixed contact
33 moving contact
34 freewheeling diode
35 thermal cutoff
36 auxiliary conductor
37 damping element
38 return spring
39 contact pressure spring
40 support body
41 column
42 (upper) platform
43 (lower) platform

44 pocket
45 wall
46 holder
47 holder
48 holder
49 holder
50 holder
60 section
61 section
62 film hinge
63 control electronics
64 snap hook
65 projection
66 (voltage pickoff) terminal
70 radial web
71 shoulder
72 collar
73 trough
74 potting compound
80 radial projection
81 undercut
82 projection
83 undercut
90 contact element
91 mating contact element
92 bearing opening
100 excess pressure safeguard
101 predetermined breaking point
102 tab
103 film hinge
110 mounting surface

The invention claimed is:

1. A power relay for a vehicle, comprising:

a housing having a connector base and a housing can mounted on said connector base, said housing can being an injection molded component made of plastic;

two terminal studs for contacting a load circuit and inserted into said connector base;

a coil subassembly disposed in said housing and containing a solenoid coil, an armature, a force-transmission member and a contact bridge, said armature is coupled by said force-transmission member to said contact bridge and can be moved in said housing, under an action of a magnetic field generated by said solenoid coil, such that said contact bridge can be moved reversibly between a closed position, in which said contact bridge bridges said terminal studs in an electrically conducting manner, and an open position, in which said contact bridge is not in contact with said terminal studs; and said coil subassembly further having a magnet yoke, which has a torsionally stable structure, which is accommodated nonrotatably in said housing can over an entire axial height of said housing can.

2. The power relay according to claim 1, wherein said magnet yoke has, as said torsionally stable structure, an integral hoop angled in a U shape with legs which fit around said solenoid coil, parallel to a coil axis of said solenoid coil.

3. The power relay according to claim 1, wherein said connector base is coupled to said magnet yoke in a manner secure against rotation.

4. A power relay for a vehicle, comprising:

a housing having a connector base and a housing can mounted on said connector base, said housing can being an infection molded component made of plastic;

two terminal studs for contacting a load circuit and inserted into said connector base;

a coil subassembly disposed in said housing and containing a solenoid coil, an armature, a force-transmission member and a contact bridge, said armature is coupled by said force-transmission member to said contact bridge and can be moved in said housing, under an action of a magnetic field generated by said solenoid coil, such that said contact bridge can be moved reversibly between a closed position, in which said contact bridge bridges said terminal studs in an electrically conducting manner, and an open position, in which said contact bridge is not in contact with said terminal studs;

a potting compound, said connector base is connected fluid tightly to said housing can by means of said potting compound; and said housing can has, on an opening side, an encircling shoulder, on which said connector base rests by means of an encircling radial web, said housing can surrounding said encircling radial web on an outside by means of a collar and projects axially beyond said radial web, with a result that a trough-type receptacle for said potting compound is formed by said collar of said housing can and said connector base.

5. The power relay according to claim 4, wherein:

said collar has at least one radial contour formed therein in a form of a radial recess or of a radial projection in a region of said trough-type receptacle;

said connector base has at least one mating contour in said region of said trough-type receptacle; and said housing can and said connector base are locked relative to one another in a circumferential direction by a formation of a form-locking joint by said potting compound with said radial contour and said mating contour.

6. The power relay according to claim 5, wherein said radial contour and said mating contour each have at least one undercut formed therein, with a result that said housing can and said connector base are locked relative to one another in a radial direction by a formation of a form-locking joint by said potting compound with said radial contour and said mating contour.

7. A power relay for a vehicle, comprising:

a housing having a connector base and a housing can mounted on said connector base, said housing can being an infection molded component made of plastic;

two terminal studs for contacting a load circuit and inserted into said connector base;

a coil subassembly disposed in said housing and containing a solenoid coil, an armature, a force-transmission member and a contact bridge, said armature is coupled by said force-transmission member to said contact bridge and can be moved in said housing, under an action of a magnetic field generated by said solenoid coil, such that said contact bridge can be moved reversibly between a closed position, in which said contact bridge bridges said terminal studs in an electrically conducting manner, and an open position, in which said contact bridge is not in contact with said terminal studs; and said housing having an excess pressure safeguard, which opens a gas expulsion opening in a case of a critical excess pressure in said housing.

8. The power relay according to claim 7, wherein said excess pressure safeguard is formed by a separately produced valve, which is inserted into said housing can or said connector base.

9. The power relay according to claim 7, wherein said excess pressure safeguard is formed by a predetermined breaking point molded into said housing.

10. The power relay according to claim 9, wherein said predetermined breaking point surrounds a tab-type section of said housing from three sides, and wherein a fourth side of said tab-type section is formed as a film hinge along a connecting line extending between ends of the predetermined breaking point.

11. The power relay according to claim 9, further comprising an electric safety line being coupled mechanically to said predetermined breaking point such that said electric safety line is severed or switched through electrically if said predetermined breaking point fails, wherein said electric safety line is in operative connection with said solenoid coil such that a severing or switching through of said electric safety line which takes place if said predetermined breaking point fails brings about permanent forced electric switching off of the power relay.

12. The power relay according to claim 1, wherein said coil subassembly has, as said force transmission member between said armature and said contact bridge, a coupling rod extending along a coil axis of said solenoid coil.

13. A power relay for a vehicle, comprising:

a housing having a connector base and a housing can mounted on said connector base, said housing can being an injection molded component made of plastic;

two terminal studs for contacting a load circuit and inserted into said connector base;

a coil subassembly disposed in said housing and containing a solenoid coil, an armature, a force-transmission member and a contact bridge, said armature is coupled by said force-transmission member to said contact bridge and can be moved in said housing, under an action of a magnetic field generated by said solenoid coil, such that said contact bridge can be moved reversibly between a closed position, in which said contact bridge bridges said terminal studs in an electrically conducting manner, and an open position, in which said contact bridge is not in contact with said terminal studs; and said coil subassembly is configured as an inherently stable and coherent modular unit, and said coil subassembly having a support body, which is an integral injection molding made of plastic and onto which said solenoid coil is directly wound.

14. The power relay according to claim 13, further comprising a holder for a thermal cutoff for protecting the power relay from overheating is molded onto said support body.

15. The power relay according to claim 13, further comprising at least one holder for a fixed contact of a switching position contact for indicating a position of said contact bridge being molded onto said support body.

16. The power relay according to claim 1, further comprising control electronics, which are configured to activate said solenoid coil several times at short time intervals in a contact cleaning mode, with a result that said contact bridge strikes against said terminal studs several times.

17. A power relay for a vehicle, comprising:

a housing having a connector base and a housing can mounted on said connector base, said housing can being an injection molded component made of plastic;

two terminal studs for contacting a load circuit and inserted into said connector base;

a coil subassembly disposed in said housing and containing a solenoid coil, an armature, a force-transmission member and a contact bridge, said armature is coupled by said force-transmission member to said contact bridge and can be moved in said housing, under an action of a magnetic field generated by said solenoid coil, such that said contact bridge can be moved reversibly between a closed position, in which said contact bridge bridges said terminal studs in an electrically conducting manner, and an open position, in which said contact bridge is not in contact with said terminal studs; and control electronics, being in contact with said terminal studs, said control electronics configured to determine an electric voltage drop across said terminal studs.

18. The power relay according to claim 8, wherein said excess pressure safeguard is a spring-loaded ball valve or a diaphragm.

* * * * *